United States Patent [19]

Labellarte

[11] 4,063,498

[45] Dec. 20, 1977

[54] TRUSS FABRICATING MACHINE

[75] Inventor: Rocco A. Labellarte, Park Ridge, Ill.

[73] Assignee: Edward Hines Lumber Company, Chicago, Ill.

[21] Appl. No.: 614,305

[22] Filed: Sept. 17, 1975

[51] Int. Cl.[2] ..... B30B 3/04

[52] U.S. Cl. ..... 100/176; 100/211; 100/DIG. 13; 269/321 F

[58] Field of Search ..... 100/176, 153, 160, 173, 100/210, 211, DIG. 13; 269/321 F

[56] References Cited

U.S. PATENT DOCUMENTS

| | | | |
|---|---|---|---|
| 3,464,348 | 9/1969 | McGlinchey | 100/210 |
| 3,538,843 | 11/1970 | Lubin | 100/210 |
| 3,855,917 | 12/1974 | Farrell | 100/DIG. 13 |

*Primary Examiner*—Richard E. Aegerter
*Assistant Examiner*—L. Footland
*Attorney, Agent, or Firm*—Mason, Kolehmainen, Rathburn & Wyss

[57] ABSTRACT

A fabricating machine for setting the teeth of opposed connector plates into wooden truss members. The machine includes a first, assembly station and a second, pre-press station across from the assembly station. A roller press having upper and lower rollers is disposed at one end of the pre-press station through which an assembled truss member and jigging pass to drive connector plates into the upper and lower sides of the truss member at the joints of the wooden components thereof. A third, post-press station is provided on the opposite side of the roller press in alignment with the pre-press station for receiving a completed truss member and its jigging. A fourth, unload station is provided across from the post-press station and in alignment with the assembly station so that a completed truss member can be removed from the jigging and the jigging returned directly to the first, assembly station. The jigging includes a separate reaction assembly disposed beneath each joint between the wooden components to support and position a connector plate.

Each reaction assembly includes a plurality of individually transversely extending side-by-side reaction pads on which the connector plate is supported. The reaction blades are independently vertically moveable upon engagement with the lower roller of the roller press seriatim from lower supporting positions to upper pressing positions driving the teeth of the connector plate into the adjacent wooden components of the truss member at the joint thereof.

17 Claims, 7 Drawing Figures

FIG. 5
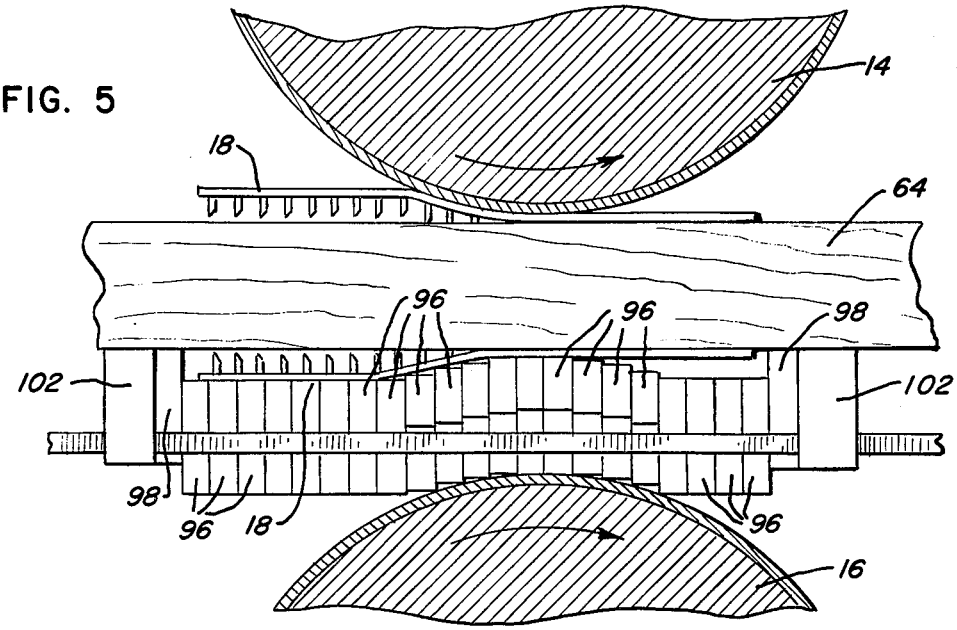
FIG. 6
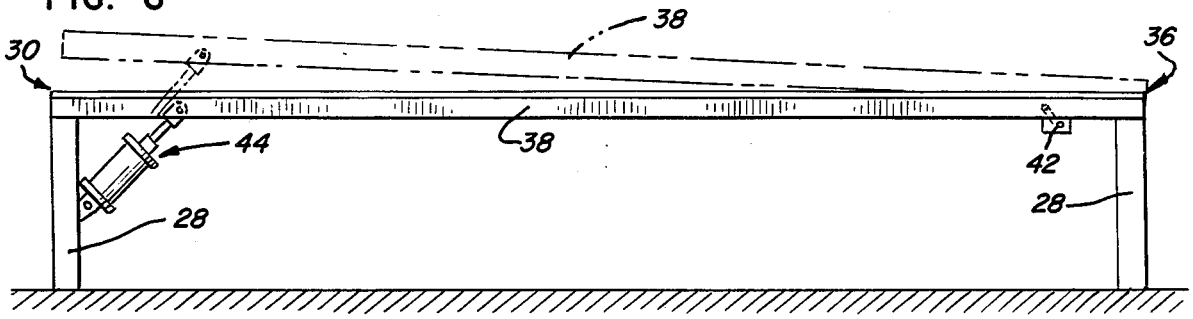
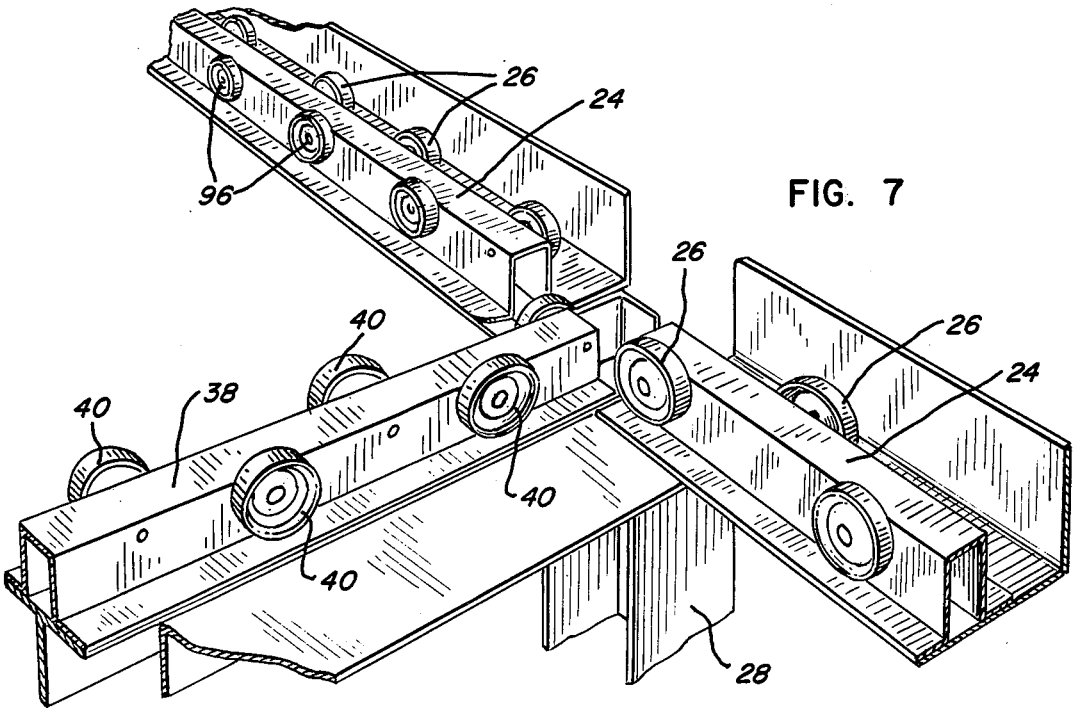
FIG. 7

TRUSS FABRICATING MACHINE

BACKGROUND AND SUMMARY OF THE INVENTION

This invention relates to prefabrication of trusses, particularly wooden trusses, and specifically to a fabricating machine for setting the teeth of opposed connector plates into wooden truss members.

The machine utilizes a roller press having upper and lower press rollers for simultaneously driving upper and lower connector plates into the wooden components of a truss member. The machine is such that the truss members can be fabricated by having operators at only two stations, with no handling of the truss member therebetween.

More particularly, the fabricating machine is elongated and extends on opposite sides of the roller press, as well as protruding beyond one end of the roller press. A first, assembly station is provided along one side of one end of the elongated machine for supporting components of a truss member for assembly into suitable jigging. A second, pre-press station for supporting an assembled truss member and its jigging is disposed along the opposite side of the one end of the machine across from the assembly station. A third, post-press station is disposed along the same side of the machine as the pre-press station but at the opposite end of the machine. The roller press is disposed between the pre-press and post-press stations. A fourth, unload station is disposed across from the post-press station in alignment with the assembly station where the completed truss member can be removed from the jigging. The empty jigging then simply is moved past one end of the roller press back to the assembly station for continuous operation. All of the stations have roller means on the top thereof across which the truss member and jigging move. In addition, transport frameworks having rollers on the top thereof are provided between the assembly and pre-press station as well as from the postpress station and the unload station. Each of the transport frameworks are hydraulically liftable at one end to cause the truss member and jigging to move to the proper station under gravity.

In addition, the jigging is provided with novel means for supporting the connector plates on the underside of the truss member and for facilitating driving the teeth of the connector plates into the wooden components of the truss member by means of the lower roller of the roller press. In particular, a separate reaction assembly is mounted on the jigging beneath each joint between the wooden components of the truss member to support and position a connector plate. Each reaction assembly includes a plurality of individual transversely extending side-by-side reaction blades on which the connector plate is supported. The blades are independently vertically movable upon engagement with the lower roller of the roller press seriatim from lower supporting positions to upper pressing positions driving the teeth of the connector plate into the underside of the adjacent wooden components of the truss member at the joints thereof. The reaction blades are individually removably mounted so as to permit varying the number thereof to accommodate different sized connector plates. An adjustable clamp is positioned at each end of the reaction blade assembly to position varying numbers of the reaction blades. A transverse positioning blade is disposed at each end of the assembly of reaction blades, within the clamps. The positioning blades extend above the reaction blades at least slightly higher than the teeth of the connector plate to provide for positioning of the connector plate therebetween. The two adjacent wooden components at the joint thereof rest directly on top of the two end positioning blades.

As shown in U.S. Pat. Nos. 3,464,348 and 3,855,917 "Reflex Generators" have been used utilizing blades which extend completely across the assembly machine for engaging connector plates on the underside of the truss member. Not only are these machines very expensive, but without providing individual reaction assemblies as described above and shown herein, it is very difficult to maintain proper positioning of the connector plates precisely at the joints of the wooden components of the truss member.

Other objects, features and advantages of the invention will be apparent from the following detailed description taken in connection with the accompanying drawings.

BRIEF DESCRIPTION OF THE DRAWINGS

FIG. 5 is a vertical section through the roller press showing the action of a reaction assembly for a connector plate on the under side of a truss member;

FIG. 6 is an end view of the framework for the fabricating machine showing the action of the hydraulically operated transport mechanism between opposing stations; and FIG. 7 is an enlarged perspective view showing the orientation of the rollers which are disposed on all of the supporting framework members of the machine.

DETAILED DESCRIPTION OF THE INVENTION

Figure 1:
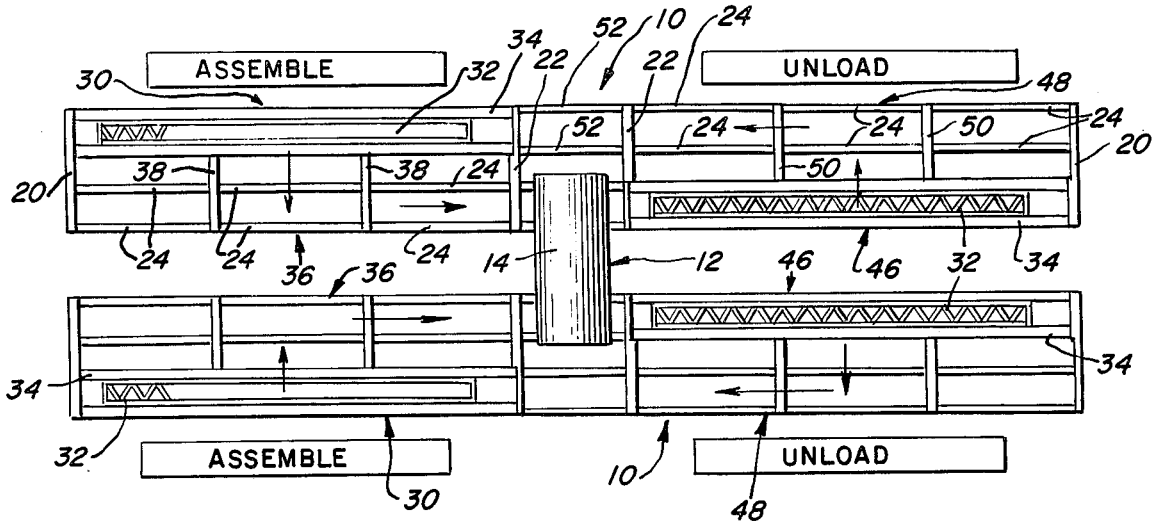
FIG. 1 is a top plan view, somewhat schematic, of the layout of two fabricating machines of the present invention utilizing a single roller press.

Before proceeding, it should be noted that, as stated above, the rollers on the top of the various framework components of the fabricating machine of the present invention are not shown in FIGS. 1 and 6 so as to avoid cluttering these drawings which would result in obscuring the overall concept.

Turning first to FIG. 1, two elongated fabricating machines of the present invention, generally designated 10, are shown utilizing a single roller press, generally designated 12. The roller press is not shown in detail in that it could comprise many constructions such as that shown in the aforesaid U.S. Pat. No. 3,855,917. Suffice it to say, the roller press includes an upper roller 14 and a lower roller 16 (FIG. 5). The rollers extend transversely of the elongated fabricating machines 10 and are vertically spaced as shown in FIG. 5 so that a truss member and its jigging, described hereinafter, can pass therethrough to drive upper and lower connector plates 18 into the wooden components of a truss member.

Turning back to FIG. 1, only the upper fabricating machine 10 will be described since the lower fabricating machine is identical but simply reversed, as shown. The upper fabricating machine includes a framework having end cross members 20, central cross members 22 on opposite sides of the roller press, and a plurality of longitudinal frame members 24 extending lengthwise of the machine. Each of the longitudinal frame members 24, as seen in FIG. 7, are provided with a plurality of rollers 26 for transport of a truss member and jigging lengthwise of the machine as described hereinafter. The frame members 20, 22 and 24 are supported at appropriate positions by supporting legs 28 (FIG. 6).

Figure 2:
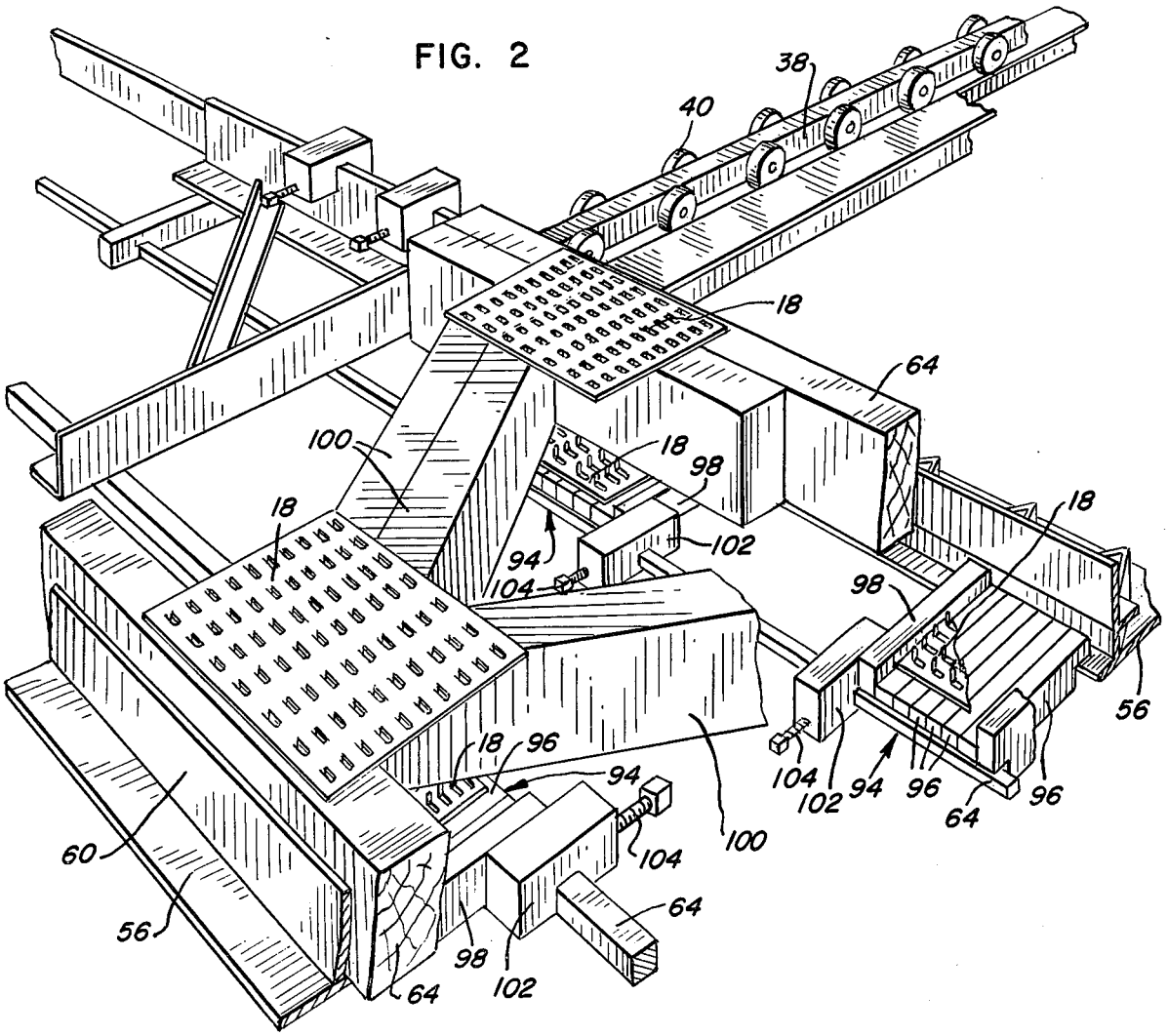
FIG. 2 is a fragmented, enlarged perspective view of a portion of the fabricating machine showing part of a truss member assembled in jigging containing reaction assemblies of the present invention.

The fabricating machine of the present invention has four stations through which an assembled truss member and its jigging are transported. More particularly, a first, assembly station, generally designated 30, is provided by the framework at the upper lefthand corner in FIG. 1. At this station, a truss member 32 is assembled by operators into a jigging 34. Once the truss member and jigging are assembled, the assembly is transported to a pre-press station, generally 36. To this end, transport means is provided in the form of a pair of cross members 38 provided between the two stations, the cross members 38 having rollers 40 on the top thereof as best seen in FIGS. 2 and 7. Referring to FIG. 6, each cross member 38 is pivoted as at 42 at one end, as at 42, beneath the pre-press stations 36. The other end of each cross member 38 is connected to the piston of a hydraulic piston and cylinder device 44. In this manner, once a truss member 32 and jigging 34 is assembled, the hydraulic device 44 is actuated by appropriate controls by one of the operators at the assembly station whereupon the cross members 38 are raised at the assembly station and the truss member and jigging will move by gravity to the pre-press station 36 on top of the rollers 26 (FIG. 7) of the longitudinal frame members 24. The truss member and jigging assembly then moves by gravity down the rollers 26 to the roller press 12 which, through the rotation of the rollers 14 and 16, moves the truss member and jigging through the roller as the connector plates are pressed into the wooden components of the truss member.

After the fabricated truss member and jigging passes completely through the roller press, it is disposed at a post-press station, generally designated 46 (FIG. 1). The assembly can remain at this station until selectively transported to an unload station, generally designated 48. To this end, two cross members 50 similar to the cross members 38 are provided with rollers on the top thereof for moving the truss member and jigging assembly from the post-press station 46 to the unload station 48. As with the cross members 38, hydraulic piston and cylinder devices are disposed beneath the post-press station 46 for lifting the ends of the cross members 50 thereat so that the assembly moves down the cross members 50 to the unload station 48 where operators can unload the completely fabricated truss member from its jigging.

After the truss member has been unloaded from its jigging at the unload station 48, the empty jigging can be manually moved back to the assembly station over the rollers 26 on the longitudinal frame members 24 at the unload station and across central longitudinal frame members 52 (FIG. 1) which extend between the unload station 48 and the assembly station 30. As with the longitudinal frame members 24, the central longitudinal frame members 52 have rollers on the top thereof to facilitate transporting of the empty jig.

With the above described fabricating machine, it can be seen that simple and continuous operation is effected in a single pass through the roller press 12 through the four described stations with only two stations, the assembly station 30 and the unload station 48, being manned by operators. In addition, it can be seen that at least two truss member-jigging assemblies can be transported through the machine simultaneously since a second cross member can be assembled into its jigging at the assembly station immediately after the prior assembly has been transported to the pre-press station 36.

With the fabricating machine of the present invention, a novel jigging is provided so that the machine can set the teeth of opposed upper and lower connector plates simultaneously into the wooden components of the truss members. To this end, and referring first to FIG. 4, a jigging is provided with opposed longitudinal supporting frame constructions, generally designated 54. Each frame construction includes a flat support plate 56 having supporting cross webs 58 on the top thereof. A longitudinal upright flange 60 extends along but spaced outwardly of the inner edge of the plate 56 to provide a shoulder 62 on top of which the outside longitudinal wooden components 64 (FIGS. 2 and 3) of the truss member 32 can rest. The longitudinal frame structures 54 are connected by cross braces 64. Secured to the cross braces 64 are a pair of longitudinal rectangular rods 66 extending the length of the frame structures 54.

Figure 4:
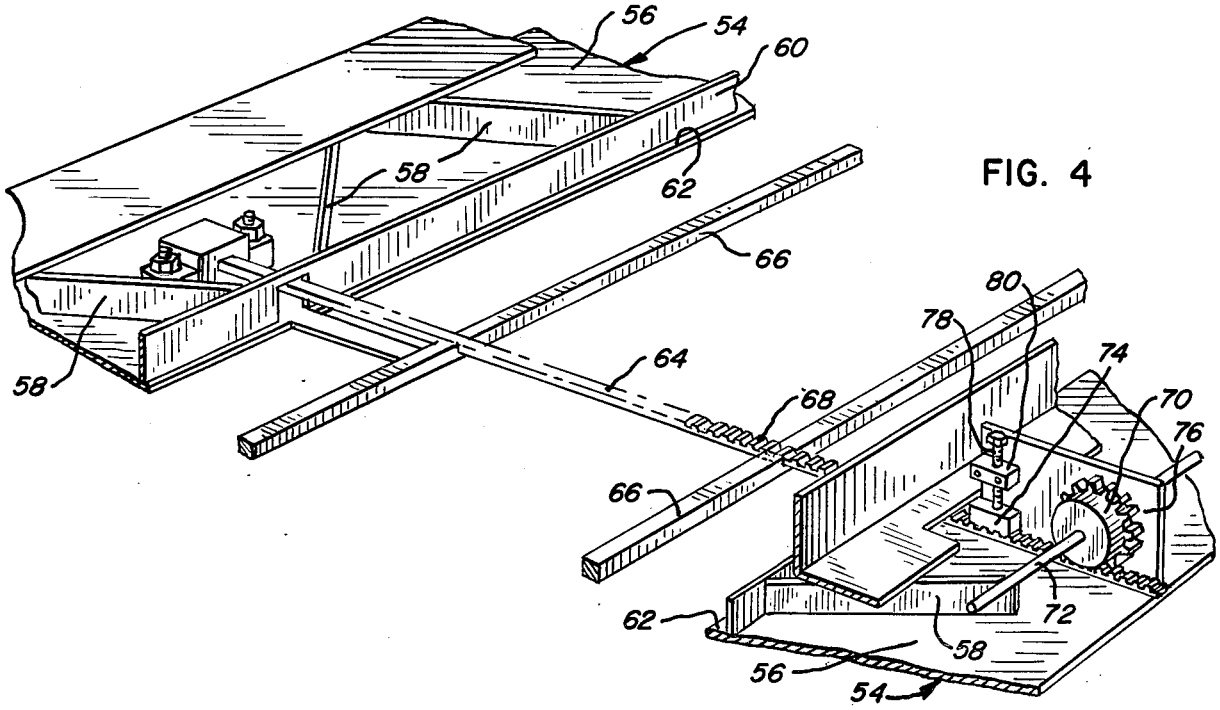
FIG. 4 is a fragmented perspective view showing a form of clamping means for the jigging for a truss member.

The portion of the jigging described above comprises clamping and retaining means for holding the wooden components of the truss member in their desired assembled positions. To this end, appropriate clamping means are provided to draw the frame structures 54 toward each other to clamp the wooden components of the truss member in position. One form of clamping means is shown in FIG. 4 and comprises a gear rack 68 formed on top of the cross braces 64. A disc gear 70 is mounted on a rod 72 in mesh with the gear rack 68. The rod has an appropriate crank on at least one end thereof for rotation of the gear 70 to move the frame structures relative to each other in a transverse direction. A holding device in the form of a toothed block 74 is provided on a frame web 76 for locking engagement with the teeth of the gear rack 68. The block 74 is mounted on the end of a bolt 78 threaded into a block 80 secured to the side of the web 76. Once the truss member is assembled and sufficiently clamped, the frame structures 54 can be held in clamping retaining relationship by threading the toothed block 74 into locking engagement with the teeth of the gear rack 68.

Figure 3:
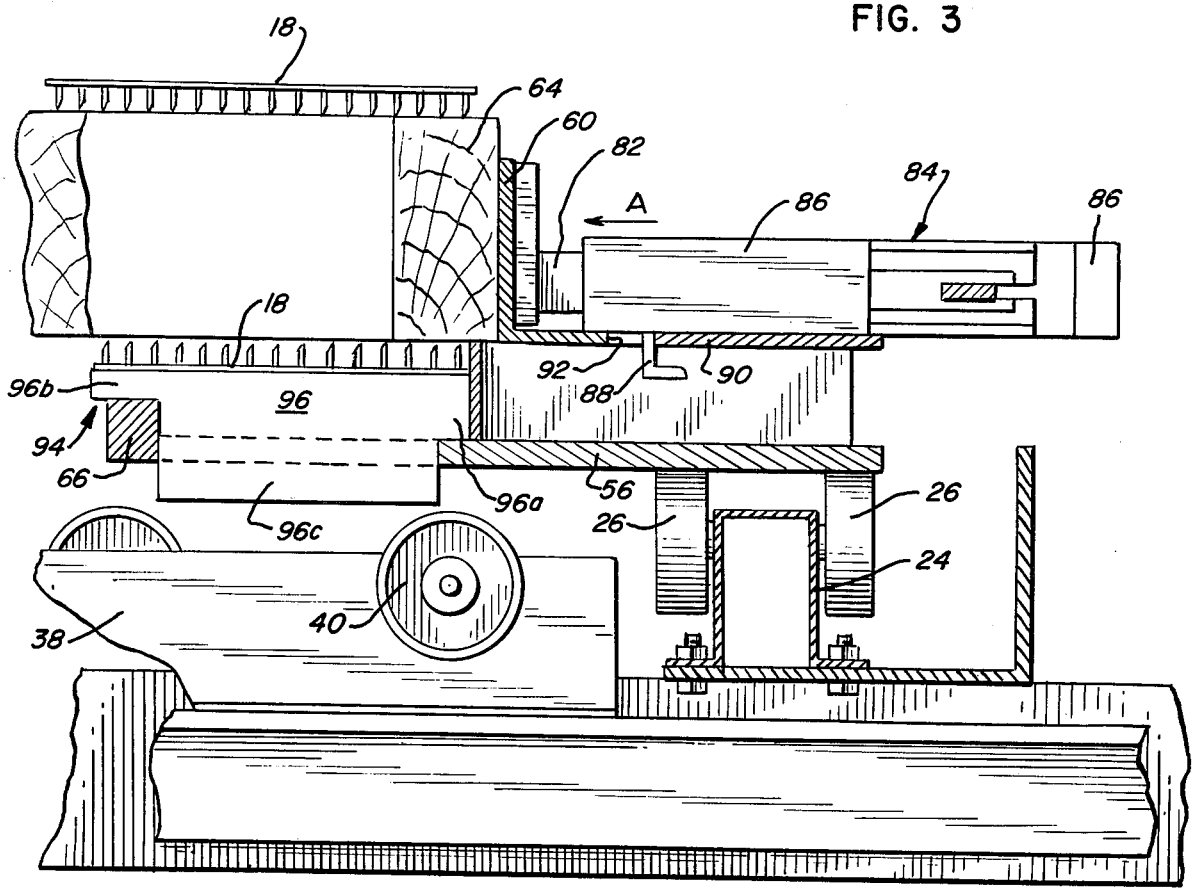
FIG. 3 is a fragmented, enlarged vertical section of a portion of the fabricating machine and showing one of the reaction blades of one of the reaction assemblies.

Another embodiment of the clamping means is shown in FIG. 3 and simply includes a plunger 82 secured by a toggle arrangement, generally designated 84, to a handle 86. When the handle 86 is pivoted, the toggle connection with the plunger 82 forces the plunger in the direction of arrow A relative to a housing 86 for the toggle arrangement, as an L-shaped flange 88 on the bottom of the housing 86 bears against a web 90 of the jigging through an aperture 92.

The jigging of the present invention includes a novel separate reaction assembly, generally designated 94 (FIGS. 2 and 3), mounted on the jigging beneath each joint between the wooden components of the truss member. Each reaction assembly supports and positions a connector plate 18 in position beneath a joint between two wooden components of the truss member.

More particularly, each reaction assembly includes a plurality of individual transversely extending side-by-side reaction blades 96 on which the connector plate 18 is supported. As can be seen in FIG. 3, each reaction blade 96 is generally T-shaped so that the outer cross portion 96*a* of the reaction blade rests on top of the support plate 56 of the frame structures 54 of the jigging. The inner cross portion 96*b* of each reaction blade 96 rests on top of the longitudinal members 66 of the jigging. In this manner, the reaction blades 96 are independently vertically movable.

As can be seen in FIGS. 3 and 5, the leg portion 96*c* of the T-shaped reaction blades protrude downwardly beyond the underside of the remainder of the jigging so as to be engageable with the top of the lower roller 16 of the roller press. Thus, as the assembled truss member and jigging assembly pass through the roller press, the reaction blades 96 of each of the separate reaction assemblies at each joint of the truss member are biased from lower supporting positions to upper pressing positions driving the teeth of the connector plate 18 supported thereby into the adjacent wooden components of the truss member, as shown in FIG. 5.

Referring to FIG. 2, it can be seen that a pair of positioning blades 98 are provided at opposite ends of the set of reaction blades 96. The positioning blades are higher than the reaction blades so as to extend thereabove and provide for positioning of a connector plate therebetween. In addition, the positioning blades 98 extend sufficiently above the reaction blades 96 so as to protrude at least slightly higher than the teeth of the connector plate. Therefore, the longitudinal wooden components 64 as well as the cross wooden components 100 of a truss member rests directly on top of the end positioning blades 98 when in clamped position. Thus, once all of the wooden components of a truss assembly are arranged and clamped by the jigging, the connector plates simply are positioned on top of the wooden components as shown in FIG. 2, and the lower connector plates simply are slid into the pocket formed by the positioning blades 98 and on top of the reaction blades 96. The speed of assembly readily is apparent.

In order to maintain the reaction blades 96 and the positioning blades 98 in proper position to define the joints of the truss member, clamp blocks 102 (FIG. 2) are provided on the longitudinal members 66 of the jigging and are held in clamped positions by a set screw 104 which threadingly clamps against the member 66.

It should be noted that the underside of the positioning blocks 98 do not protrude downwardly below the underside of the jigging so as not to be engageable by the lower roller of the roller press, as seen in FIG. 5.

The foregoing detailed description has been given for clearness of understanding only and no unnecessary limitations should be understood therefrom as some modifications will be obvious to those skilled in the art.

I claim:

1. An elongated fabricating machine for setting the teeth of opposed connector plates into wooden truss members, comprising: means defining a first assembly station along one side of one end of the elongated machine for supporting components of a truss member for assembly into suitable jigging; means defining a second, pre-press station for supporting an assembled truss member and jigging along the opposite side of said one end of the machine; means defining a third, post-press station for supporting an assembled truss and jigging member along said opposite side of the opposite side of the machine; a roller press disposed between said second and third stations and including transversely extending, vertically spaced upper and lower rollers for pressing the teeth of upper and lower connector plates into the components of the assembled truss member; means defining a fourth, unload station along said one side of the opposite end of the machine for supporting the completed truss member and jigging and where the completed truss member can be removed from the jigging and transport means between said first and second stations for moving an assembled truss member and jigging therebetween.

2. The fabricating machine of claim 1 including means interconnecting said first and fourth stations to provide means on which an empty jig may be returned from the fourth, unload station to the first, assembly station.

3. The fabricating machine of claim 1 wherein said transport means comprises a framework having roller means on the top thereof engageable with the underside of the assembled truss member and jigging.

4. The fabricating machine of claim 3 including hydraulic means for lifting the end of said framework at said first station to permit the assembled truss member and jigging to move by gravity over said roller means from said first to said second stations.

5. An elongated fabricating machine for setting the teeth of opposed connector plates into wooden truss members, comprising: means defining a first assembly station along one side of one end of the elongated machine for supporting components of a truss member for assembly into suitable jigging; means defining a second, pre-press station for supporting an assembled truss member and jigging along the opposite side of said one end of the machine; means defining a third, post-press station for supporting an assembled truss and jigging member along said opposite side of the opposite side of the machine; a roller press disposed between said second and third stations and including transversely extending, vertically spaced upper and lower rollers for pressing the teeth of upper and lower connector plates into the components of the assembled truss member; means defining a fourth, unload station along said one side of the opposite end of the machine for supporting the completed truss member and jigging and where the completed truss member can be removed from the jigging and transport means between said third and fourth stations for moving a completed truss member and jigging therebetween.

6. The fabricating machine of claim 5 wherein said transport means comprises a framework having roller means on the top thereof engageable with the underside of the completed truss member and jigging.

7. The fabricating machine of claim 6 including hydraulic means for lifting the end of said framework at said third station to permit the completed truss member and jigging to move by gravity over said roller means from said third to said fourth stations.

8. The fabricating machine of claim 7 including transport means between said first and said second stations in the form of a framework having roller means on the tops thereof engageable with the underside of the assembled truss member and jigging, and including hydraulic means for lifting the end of said framework at said first station to permit the assembled truss member and jigging to move by gravity over the roller means from said first to said second stations.

9. The fabricating machine of claim 8 including roller means at each of said four stations engageable with the underside of the truss member and jigging to permit movement thereof between the stations.

10. The fabricating machine of claim 9 including means interconnecting said first and fourth stations to provide means on which an empty jig may be returned from the fourth, unload station to the first, assembly station.

11. A jigging construction for use in a fabricating machine for setting the teeth of opposed connector plates into wooden truss members at the joints of the assembled wooden components thereof, by means of passing the assembled truss member and jigging through a roller press having a pair of vertically spaced upper and lower rollers, comprising: clamping and retaining means for holding the wooden components of a truss member in their desired assembled positions, and a separate reaction assembly mounted on said clamping and retaining means beneath each joint between the wooden components to support and position a connector plate, each reaction assembly including a plurality of individual transversely extending side-by-side reaction blades on which the connector plate is supported, said blades being independently vertically movable, upon engagement with the lower roller, seriatim from lower supporting positions to upper pressing positions driving the teeth of the connector plate into the adjacent wooden components of the truss member at the joint thereof and, including a transverse positioning blade at each end of the assembly of reaction blades, the positioning blades being higher than the reaction blades so as to extend thereabove and provide for positioning of a connector plate therebetween.

12. The jigging construction of claim 11 wherein said positioning blades extend above the reaction blades at least slightly higher than the teeth of the connector plate.

13. The jigging construction of claim 12 wherein said positioning blades are mounted on said clamping and retaining means so as to support the underside of two adjacent wooden components at the joint thereof.

14. The jigging construction of claim 11 including a transverse positioning blade at each end of the assembly of reaction blades, the positioning blades being higher than the reaction blades so as to extend thereabove and provide for positioning of a connector plate therebetween.

15. A jigging construction for use in a fabricating machine for setting the teeth of opposed connector plates into wooden truss members at the joints of the assembled wooden components thereof, by means of passing the assembled truss member and jigging through a roller press having a pair of vertically spaced upper and lower rollers, comprising: clamping and retaining means for holding the wooden components of a truss member in their desired assembled positions, and a separate reaction assembly mounted on said clamping and retaining means beneath each joint between the wooden components to support and position a connector plate, each reaction assembly including a plurality of individual transversely extending side-by-side reaction blades on which the connector plate is supported, said blades being independently vertically movable, upon engagement with the lower roller, seriatim from lower supporting positions to upper pressing positions driving the teeth of the connector plate into the adjacent wooden components of the truss member at the joint thereof, said reaction blades being individually removably mounted so as to permit varying the number thereof to accommodate different sized connector plates.

16. The jigging construction of claim 15 wherein said reaction assembly includes adjustable clamp means to position varying numbers of said reaction blades.

17. The jigging construction of claim 15 wherein said reaction blades are generally T-shaped with the ends of the cross of the T-shape positionable on spaced longitudinal supports of the jigging and with the leg of the T-shaped engageable with the lower roller of said roller press.

* * * * *